US005830073A

United States Patent [19]

Voss

[11] Patent Number: 5,830,073

[45] Date of Patent: Nov. 3, 1998

[54] BOWLING LANE SURFACES

[76] Inventor: Brian C. Voss, 340 Banyon Brook Pointe, Roswell, Ga. 30076

[21] Appl. No.: 749,538

[22] Filed: Nov. 15, 1996

Related U.S. Application Data

[63] Continuation-in-part of Ser. No. 508,819, Jul. 28, 1995, abandoned.

[51] Int. Cl.[6] ..... A63D 1/04

[52] U.S. Cl. ..... 473/54; 473/115

[58] Field of Search ..... 473/54, 55, 58, 473/115, 116, 117

[56] References Cited

U.S. PATENT DOCUMENTS

| | | | |
|---|---|---|---|
| 271,530 | 1/1883 | Spang . | |
| 1,708,101 | 4/1929 | Kornsweet | 473/117 |
| 1,829,239 | 10/1931 | Schnitman | 473/115 |
| 1,987,000 | 1/1935 | Cahill | 273/37 |
| 2,296,471 | 9/1942 | Kennedy | 473/115 |
| 3,228,692 | 1/1966 | Brubaker | 473/115 |
| 3,392,975 | 7/1968 | Winkleman, Jr. | 473/115 |
| 3,841,632 | 10/1974 | Schwartz | 273/39 |
| 5,096,192 | 3/1992 | Stanford, Jr. | 273/39 |
| 5,304,097 | 4/1994 | Duff | 473/113 |
| 5,316,521 | 5/1994 | Ayre, Jr. | 473/115 |

*Primary Examiner*—William M. Pierce

*Attorney, Agent, or Firm*—Webb Ziesenheim Bruening Logsdon Orkin & Hanson, P.C.

[57] ABSTRACT

A bowling lane surface for use with a bowling ball and bowling pins. The playing surface is adapted to have bowling pins set up at one end of the bowling lane and a bowling ball thrown by a bowler at an opposite end so that the bowling ball moves on the surface toward the bowling pins. The playing surface includes at least one visual obstacle between the two ends of the playing surface. Those visual obstacles can be colored areas showing varying friction levels, moguls or depressions along the bowling lane surface. The bowling lane preferably is an oilless lane and can be made of either wood, laminated compressed paper, or plastic.

21 Claims, 15 Drawing Sheets

BOWLING LANE SURFACES

This invention is a Continuation-In-Part of U.S. patent application Ser. No. 08/508,819, filed Jul. 28, 1995 now abandoned.

BACKGROUND OF THE INVENTION

1) Field of the Invention

This invention relates to games and, more particularly, to bowling games.

2) Description of the Prior Art

Over the years, the sport of bowling has substantially evolved. Initially, bowling alleys hired pin setters to set the bowling pins after the ball was thrown. Today, such pin setters are essentially nonexistent and automatic pin setting and ball returns are a standard. Within the past twenty to thirty years, a substantial amount of research, development and technology has also gone into bowling lane and bowling ball designs, primarily related to the bowling lane surfaces, the oiling procedures of those surfaces and the bowling balls. All of these advances affect the control a bowler has over a bowling ball.

A bowler accurately controls the bowling ball not only by where he or she throws the ball or by how hard the ball is thrown, but also by the appropriate rotation or spin applied to the ball. The rotation or spin and speed of the ball affect the "skid", "roll" and "curve" or "hook" characteristics of the ball. The coefficient of friction between the ball, lane surface and oil affect these characteristics. Changing the properties of the ball, lane surface and/or oil may affect the ball's characteristics.

The bowling industry, in general, has tried many different oiling procedures to compensate for changes in lane surfaces and bowling balls so as to prevent advantages that may result in one type of ball over another. An important factor in applying oil to bowling lanes is the thickness and the types of oils used. On a day to day comparison, each lane will be oiled differently. Further, oil on different sections of a particular lane may vary and affect a ball's performance. Therefore, the balls will react differently on different lanes or even on the same lanes on a day to day basis.

It is clearly recognized that the balls and the lane surfaces can be manufactured to have certain known characteristics. However, the true variable of the lane surface, ball and oil is the oil. This is especially true since the oil is colorless and the bowlers have no idea of the type of oil and the thickness of the oil applied to the bowling lane surface on any particular day.

Specifically, throughout the history of bowling, conditions of the lanes have been varied so that the ball will react with the lane to produce the specific "skid", "roll" and "curve" or "hook" characteristics, which maximize the bowler's potential for obtaining strikes. Preferably, the lane is divided into three different sections, each with its own function. FIG. 1 shows such a level bowling lane 10 having ten bowling pins 12 provided at one end and adapted for a bowling ball 14 to be rolled from the other end towards the bowling pins 12. Depending on the amount of "skid", "roll" and "curve" or "hook", the ball 14 will follow different paths, such as 16, 16' and 16". Presently, the bowling alleys are made of wooden boards 18 or synthetic lanes made from compressed paper extending longitudinally along the bowling lane and having a lubricant or oil 20 applied to an upper surface of the lane 10. FIG. 2 shows a cross section of the wooden boards and the lubricant applied thereto.

Generally speaking, the bowling lane 10 can be divided into three sections: a laydown area 22, a directional area 24 and a back end area 26. The laydown area 22 is positioned at the forward portion of the lane 10 closest to the bowler and is where the bowler throws the ball. The laydown area 22 is of utmost importance in terms of measuring accuracy, because the slightest change in direction at the forward portion of the lane 10 is magnified at the end portion of the lane 10 near the pins 12. The ability to "skid" the ball, unaffected by friction, enables a player to rotate the bowling ball and accurately roll it towards the given target. Modern oiling procedures require a heavy concentration of oil on the laydown area 22 to achieve this function. The directional area 24 is the middle of the lane 10. This is the area of the lane 10 where the ball's rotation causes it to hook and/or curve toward the pins 12. The bowler must determine where the ball must enter directional area 24 and at which angle. The oiling characteristics in the directional area 24 are different than in laydown area 22. Typically, the oil is distributed unevenly throughout the directional area 24.

The back end area 26 is the last part of the lane that the ball rolls on before it enters the pocket. The striking potential is affected by increasing or decreasing friction levels. With less friction, the ball will have a tendency to deflect more, lessening a player's chance of obtaining a strike. With more friction, the ball tends to hit the pins harder, thereby increasing the player's chances of obtaining a strike. Modern day conditions allow for a lot of friction, which creates better scores.

Various definitions have been proposed defining what the ideal bowler must possess. One definition is that the best or most ideal bowler in the world will be the person who can repeat his/her approach and release more times than the next player does and can manipulate a bowling ball to achieve a certain rotation or spin and arc that best takes advantage of a given condition, combined with supreme response to crucial situations. The other definition is that the best or most ideal bowler in the world is the person who can repeat his/her approach and release more times than the next person does, combined with supreme response to crucial situations. The latter definition has been proposed for use with an "oilless lane". One such example would be to make the lanes out of a plastic material or coat the wooden lanes with a plastic material that will not require oiling. In this manner, oil will have no bearing on the bowling game. However, once the oil variable is eliminated, it is conceivable that bowling would become extremely boring to the bowler who perfects his or her release of the ball.

Therefore, it is the object of my invention to create a bowling lane that requires no oil and challenges a bowler's skill in throwing the bowling ball.

SUMMARY OF THE INVENTION

My invention is a bowling lane for use with a bowling ball and bowling pins that includes a playing surface adapted to bowling pins set up at one end of the lane and a bowling ball thrown by a bowler at an opposite end so that the bowling ball moves on the surface toward the bowling pins. The playing surface includes at least one visual obstacle between the two ends of the playing surface. That obstacle can be a colored section that has a different coefficient of friction than the remainder of the playing surface, or a mogul, or a depression. A plurality of moguls or depressions or different friction areas can be provided. Friction areas can be of varying frictions and colors. The moguls can be provided so that they are at varying elevations or heights. The friction areas, the moguls, and/or the depressions can be combined within the lanes.

A plurality of lanes can be provided, each having a different obstacle or obstacles. Further, my invention is a game wherein the bowlers would throw a ball down each of the lanes.

DESCRIPTION OF THE PREFERRED EMBODIMENTS

Figure 2:
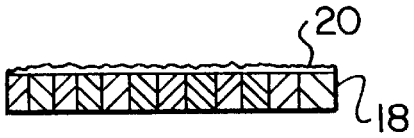
PRIOR ART FIG. 2
FIG. 2 is a section taken along lines II—II in FIG. 1.
Figure 1:
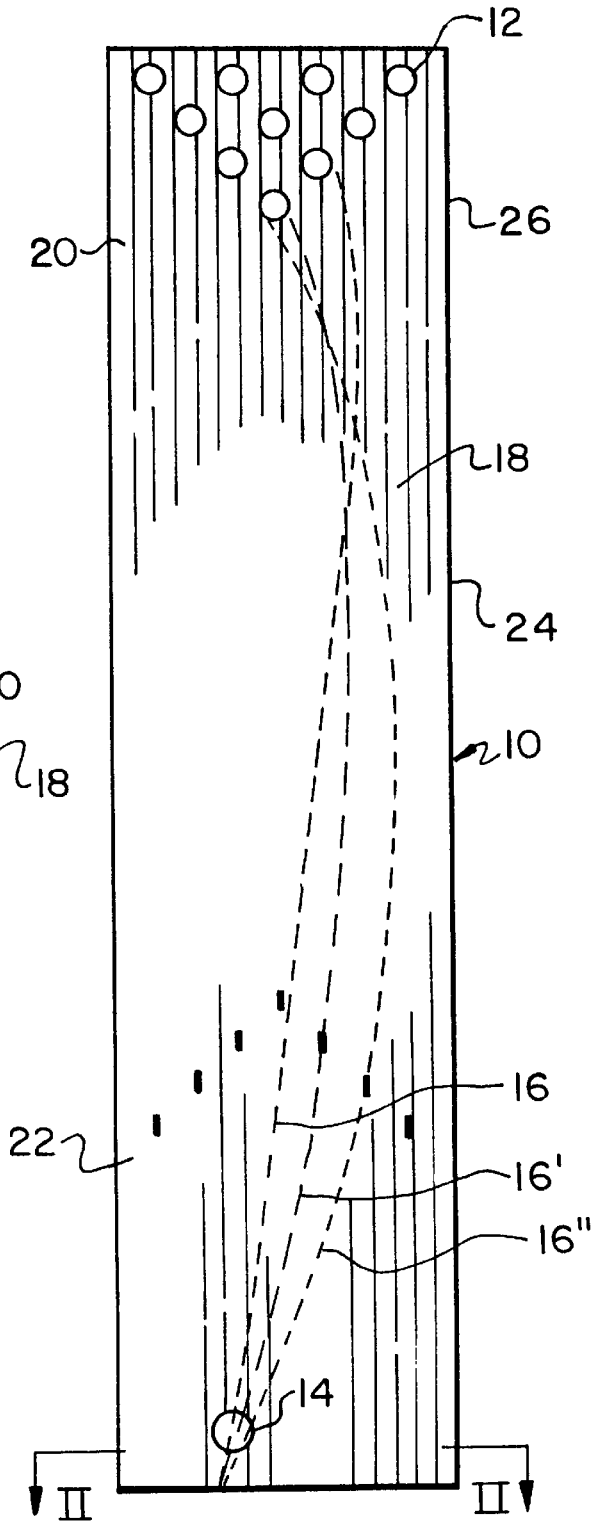
PRIOR ART FIG. 1
FIG. 1 is a top plan view of a prior art bowling alley.
Figure 3:
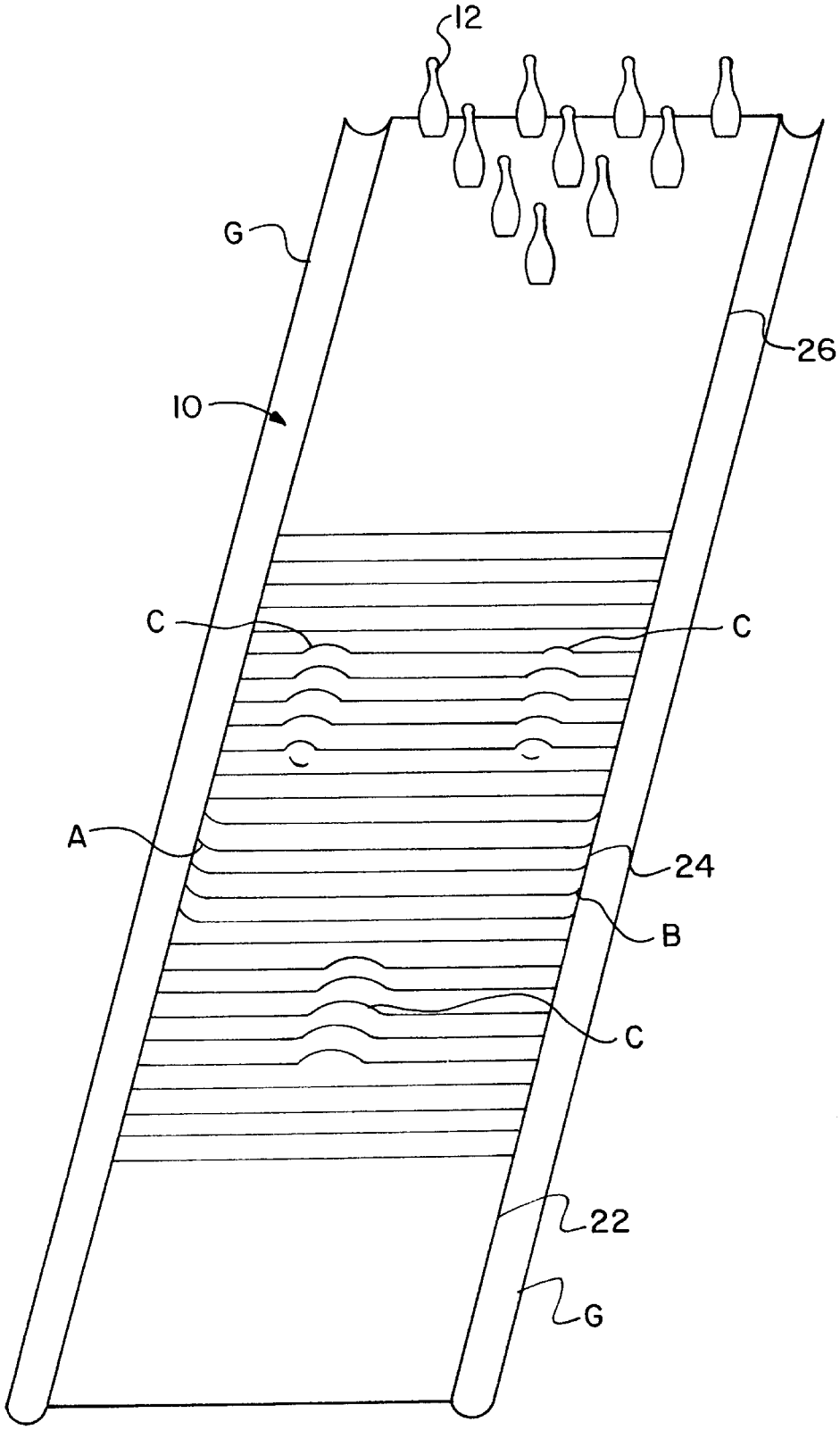
FIG. 3 shows a three-dimensional graph transposed over a standard bowling lane showing varying friction areas due to improper oiling.

FIG. 3 shows a three-dimensional graph transposed over the directional area 24 having a normal oiling procedure applied to the lane. As can be seen, the oil is not evenly applied from gutter (or channel) G to gutter (or channel) G, and it looks like a slope is present on sides A and B of the lane. The higher the slope the less oil, which results in a higher friction level. It is known that when a rotating ball hits one of the areas having less oil, it curves more. This happens because of an increase of friction between the ball and the lane. The more friction, the more hook. Conversely, when a rotating ball hits an area with more oil, it curves less. This is also true in the middle of the lane where the areas C having less oil cause the ball to hook more.

In order to take advantage of this arrangement, one would need to play the lanes differently after determining the amount of oil spread throughout the lanes. Of course, this is nearly impossible under today's bowling conditions.

Figure 4:
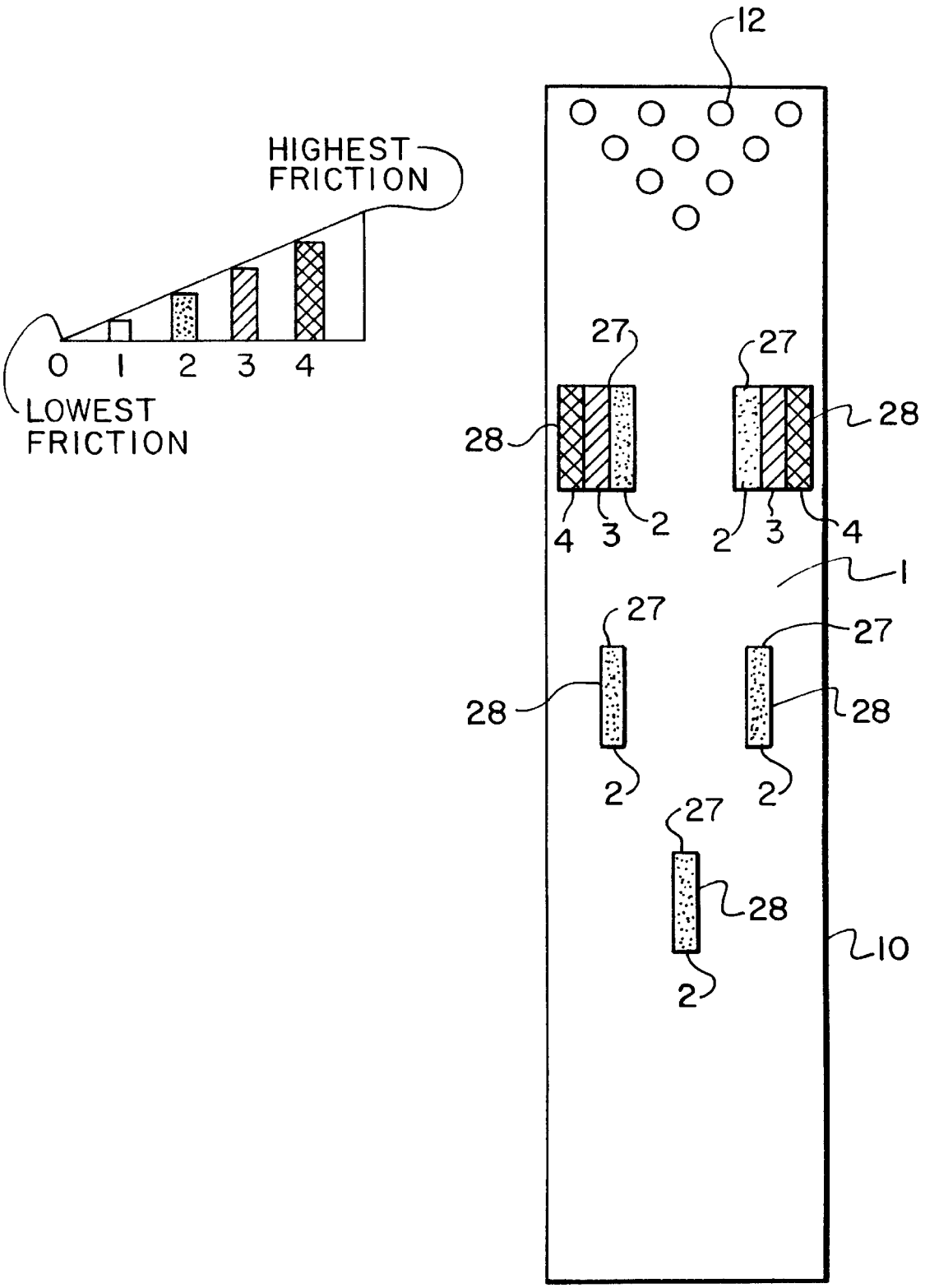
FIG. 4 shows a top plan view of a first embodiment of a bowling alley made in accordance with the present invention.

Theoretically, one way to overcome this situation is to make an "oilless lane". However, as stated in the background of the invention, the oilless lane would soon become boring once the bowlers perfected their technique. However, one way to simulate the oil type lane with an oilless lane would be to provide visible friction levels throughout the lane to simulate the amount of oil on the lane. As shown in FIG. 4, one way to do this is by providing a lane having different areas 27 having various friction levels (or coefficients of friction), say, four different friction levels (depicted as levels 1, 2, 3 and 4 in the Figures), although any number could be used. The friction levels would be colored according to their respective friction level, the lowest friction level being shaded lightest (say, white) and the highest friction level being shaded the darkest (say, black). Other colors, such as green, blue and/or purple could be used for the other friction levels. Also, indicia other than color could be used, such as the symbols shown in the Figures representing the different friction levels 1, 2, 3 and 4.

In the lane 10 shown in FIG. 4, the majority of the lane 10, which could be made of plastic, has a friction level of 1. The various other areas 27 are at varying friction levels 2, 3 and 4, each level being a different color. The areas 27 could be pads 28 attached to the lane 10 and be made of other plastics or rubber having a different coefficient of friction than the rest of the lane 10. The pads 28 could be glued or nailed to the plastic lane 10. As shown in FIG. 4, two of the areas 27 include surfaces having varying friction levels 2, 3 and 4 that are adapted to coact with the bowling ball.

Figure 5:
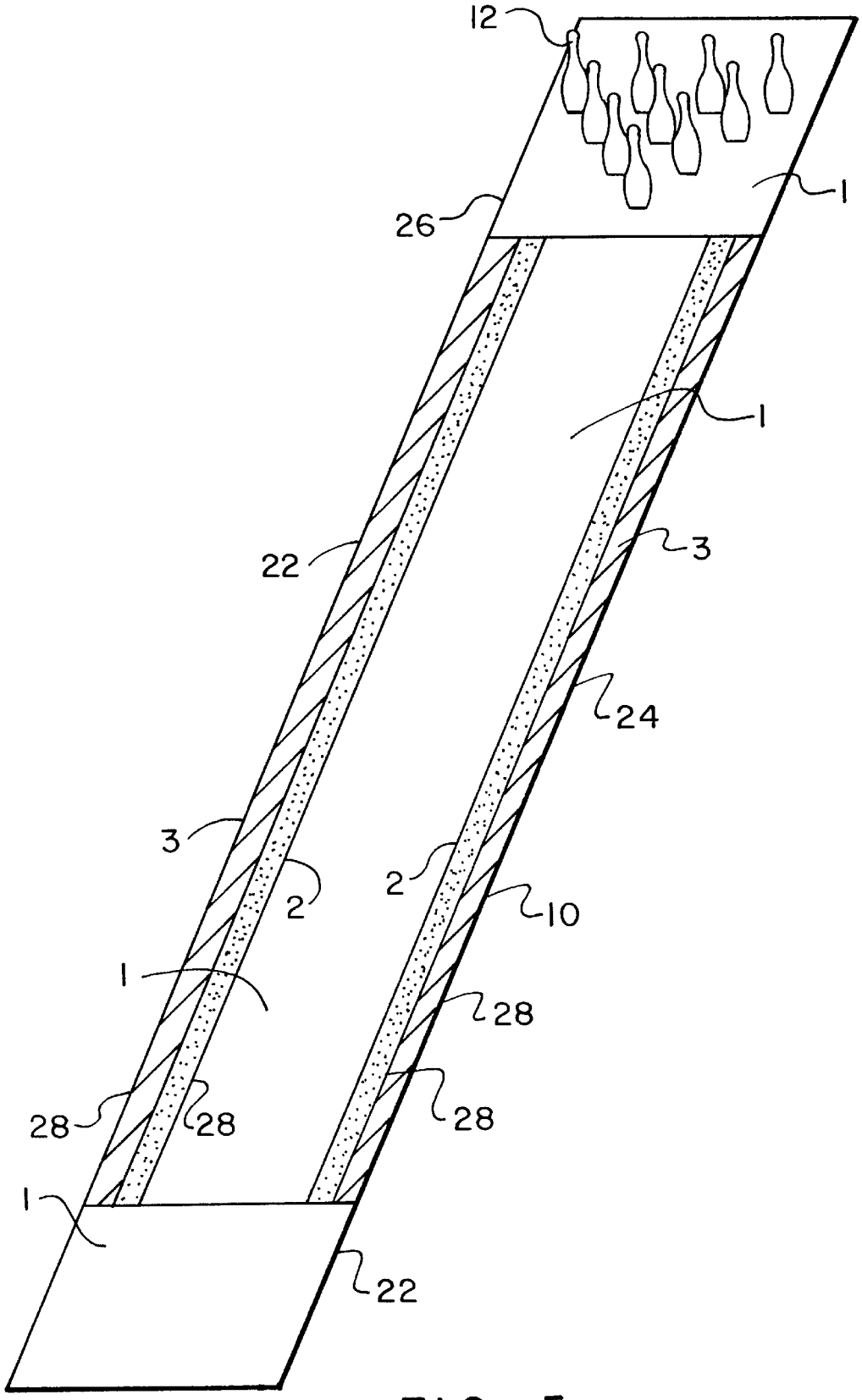
FIG. 5 shows a second embodiment of the present invention providing friction pads along the sides of the bowling lane.

FIG. 5 shows various friction pads 28 applied along the edges of the alley adjacent to the gutters having different friction levels. This simulates the present conditions of lanes having less oil adjacent the edges of the lanes than in the center of the lanes.

Figure 6:
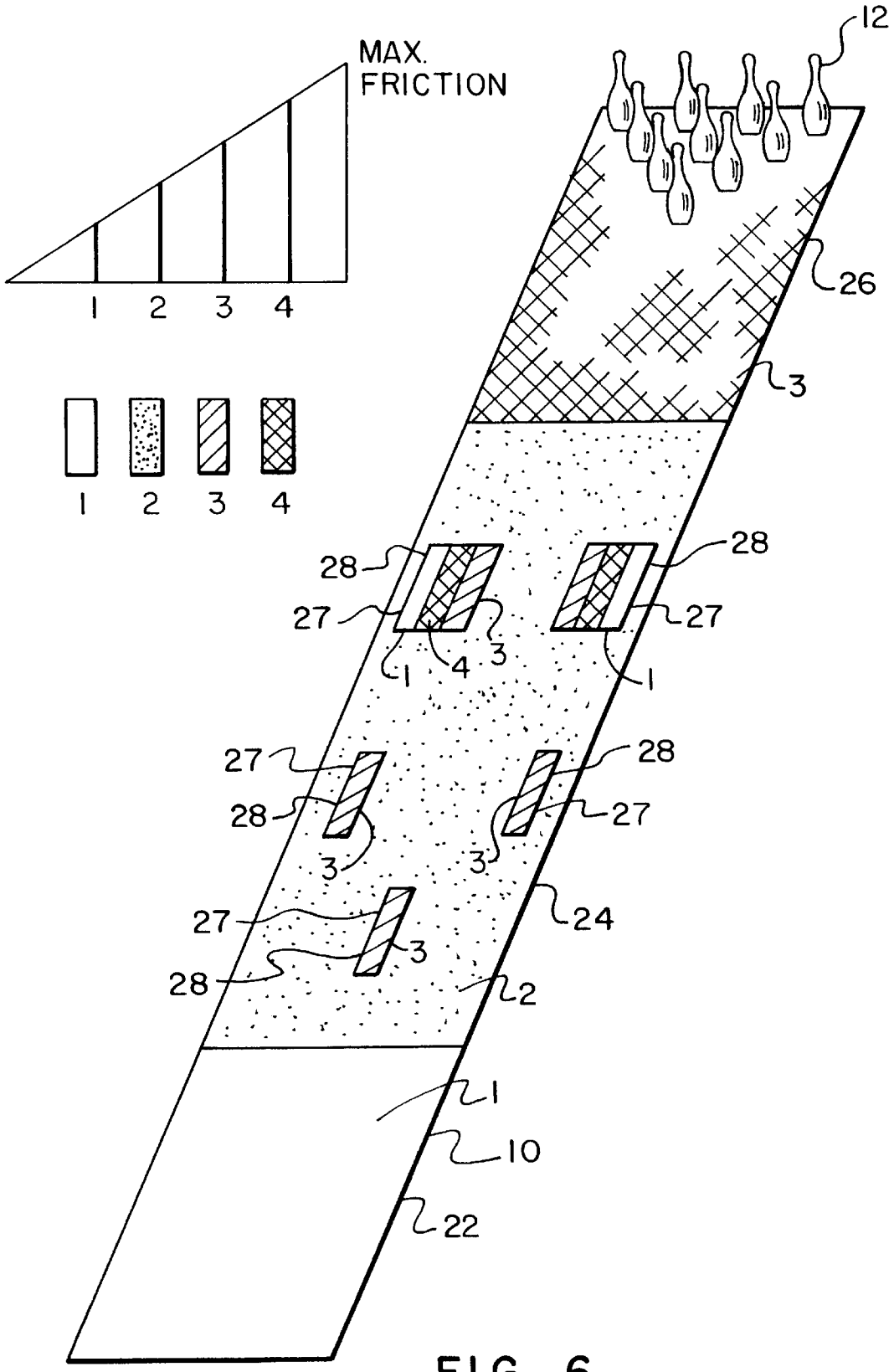
FIG. 6 shows another embodiment of the present invention providing various visual friction levels along the bowling surface.

FIG. 6 shows another arrangement having various friction pads 28 placed along areas 27 in the directional area 24 of the lane 10. Also, the laydown area 22, directional area 24 and back end area 26 have different coefficient of frictions about their respective surfaces. It is important to note that all of the areas having different coefficients of friction would be of a different color.

Figure 7:
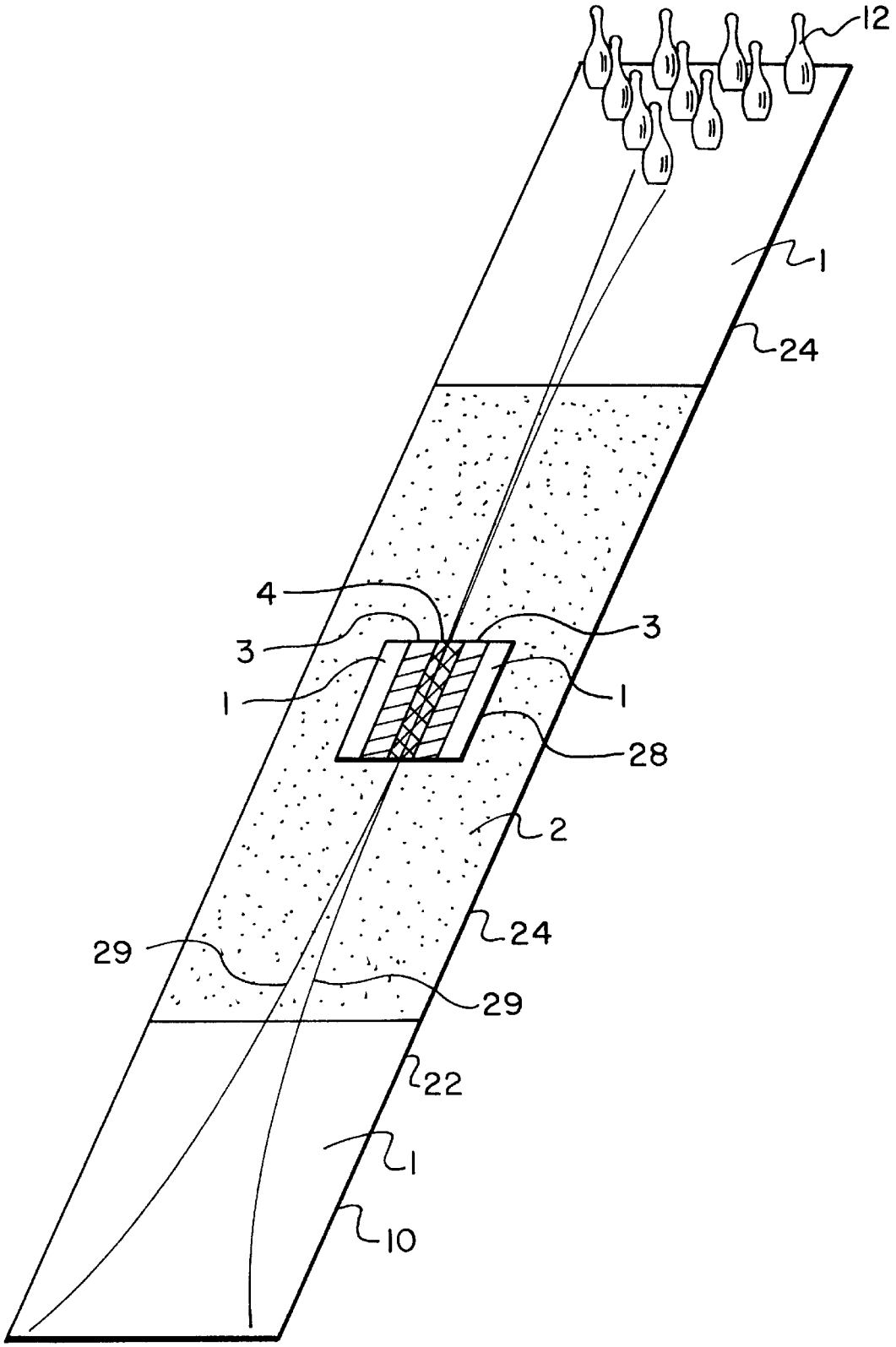
FIG. 7 shows another embodiment of the present invention showing various friction levels applied to the bowling surface.

FIG. 7 shows a friction pad 28 having varying coefficients of friction applied in a central area of directional area 24 of the lane 10. Lines 29 show the path of the ball depending on where the ball is thrown and the ball's contact with the friction pad 28.

Figure 8:
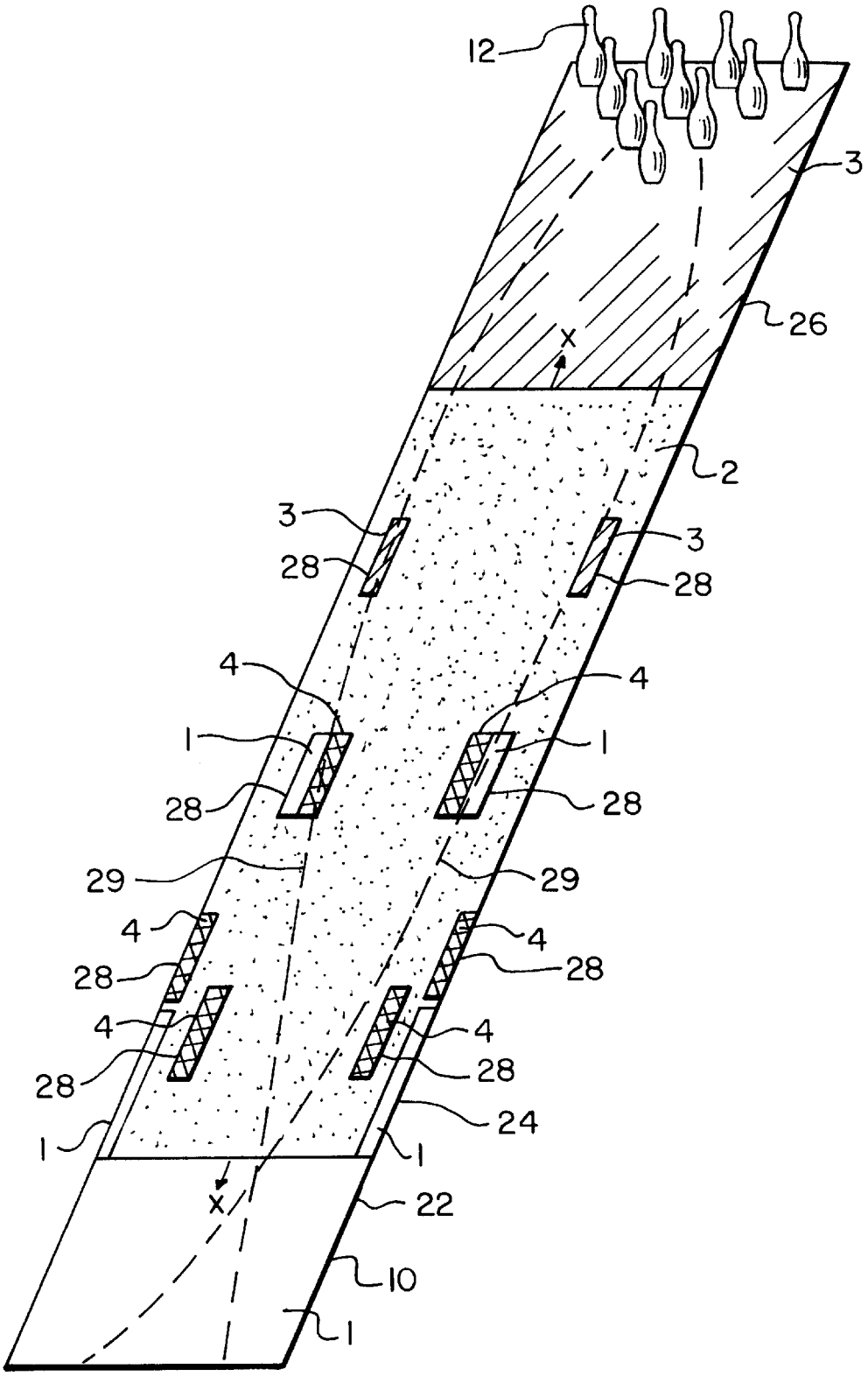
FIG. 8 shows another embodiment of the present invention showing various friction levels provided along the surface of the bowling lane.

FIG. 8 shows several friction pads 28 positioned in directional area 24. The laydown area 22 and back end area 26 have different coefficients of friction than that of the directional area 24. Lines 29 show the ball path depending on where the ball is thrown. As can be seen, the friction pads 28 are positioned symmetrical about the longitudinally extending axis "X".

Figure 9:
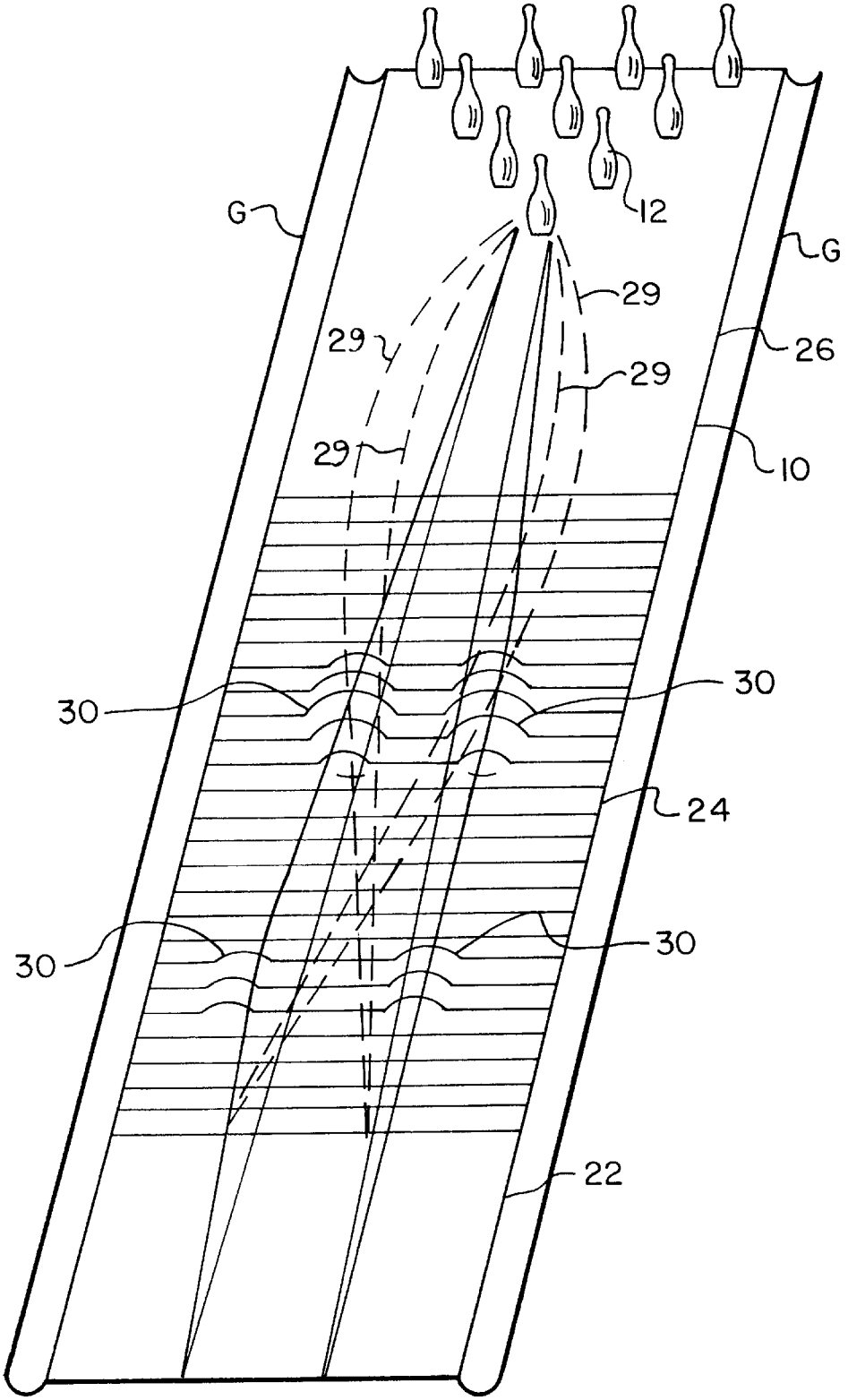
FIG. 9 shows a top perspective view of a bowling lane having moguls in accordance with the present invention.

FIG. 9 shows the positioning of moguls 30 in various areas of the directional area 24 of the lane 10. The moguls are nothing more than curved projections or bumps extending from the lane surface. The curve applied to the ball dictates where on the mogul the bowler should aim. Should the bowler miss the appropriate preferred spot on the appropriate mogul 30, a gutter ball may result. The moguls again simulate various oiling conditions that can occur on bowling alleys. Alternatively, although not shown, the moguls 30 could be replaced by or joined with depressions in the lane to achieve the same effect.

Figure 10A:
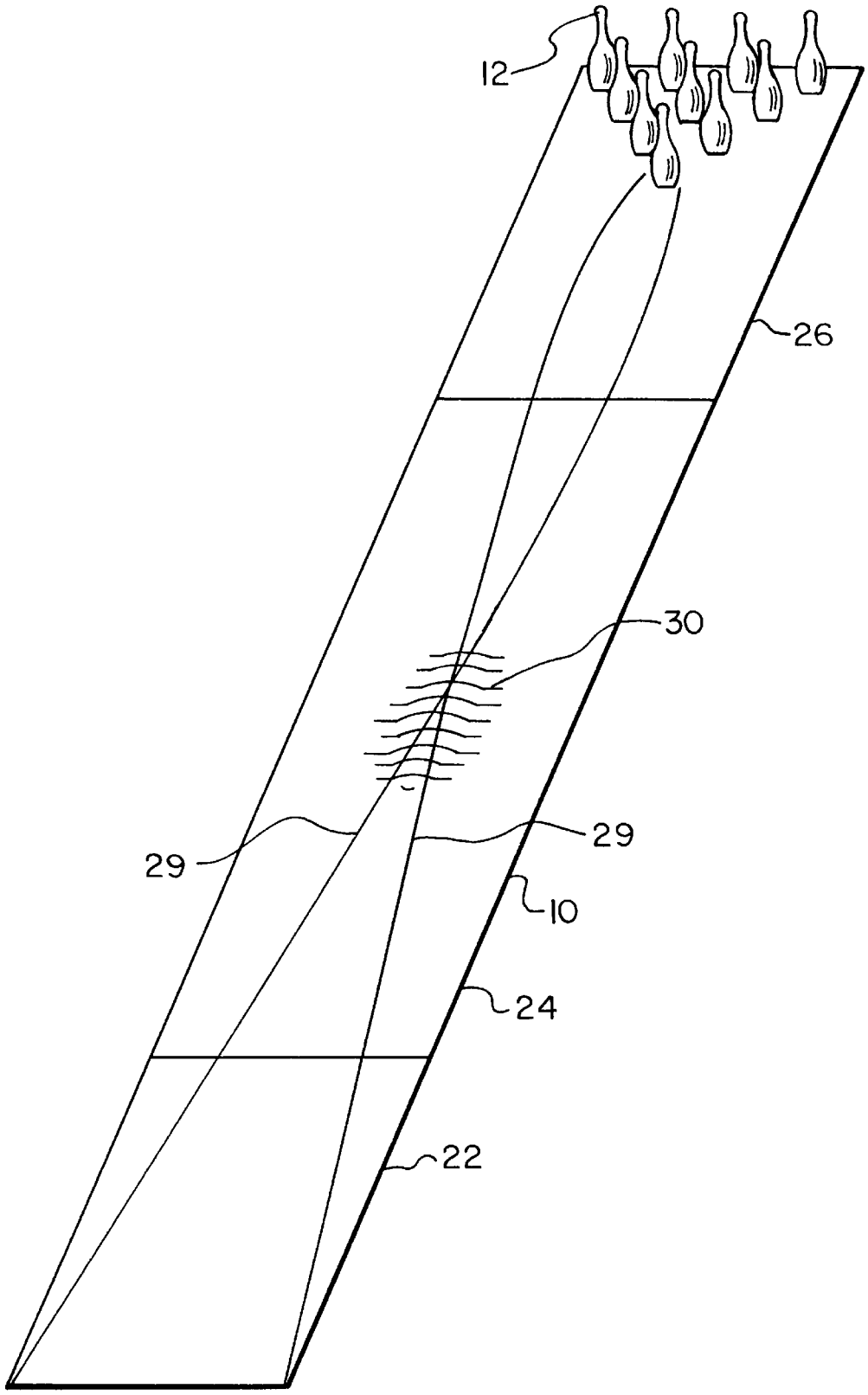
FIG. 10A shows another embodiment of the present invention of a bowling lane having a mogul.

FIG. 10A shows a central mogul 30 positioned in the center of the directional area 24. The bowler in this case would have to bowl over the mogul to properly position the bowling ball.

Figure 10B:
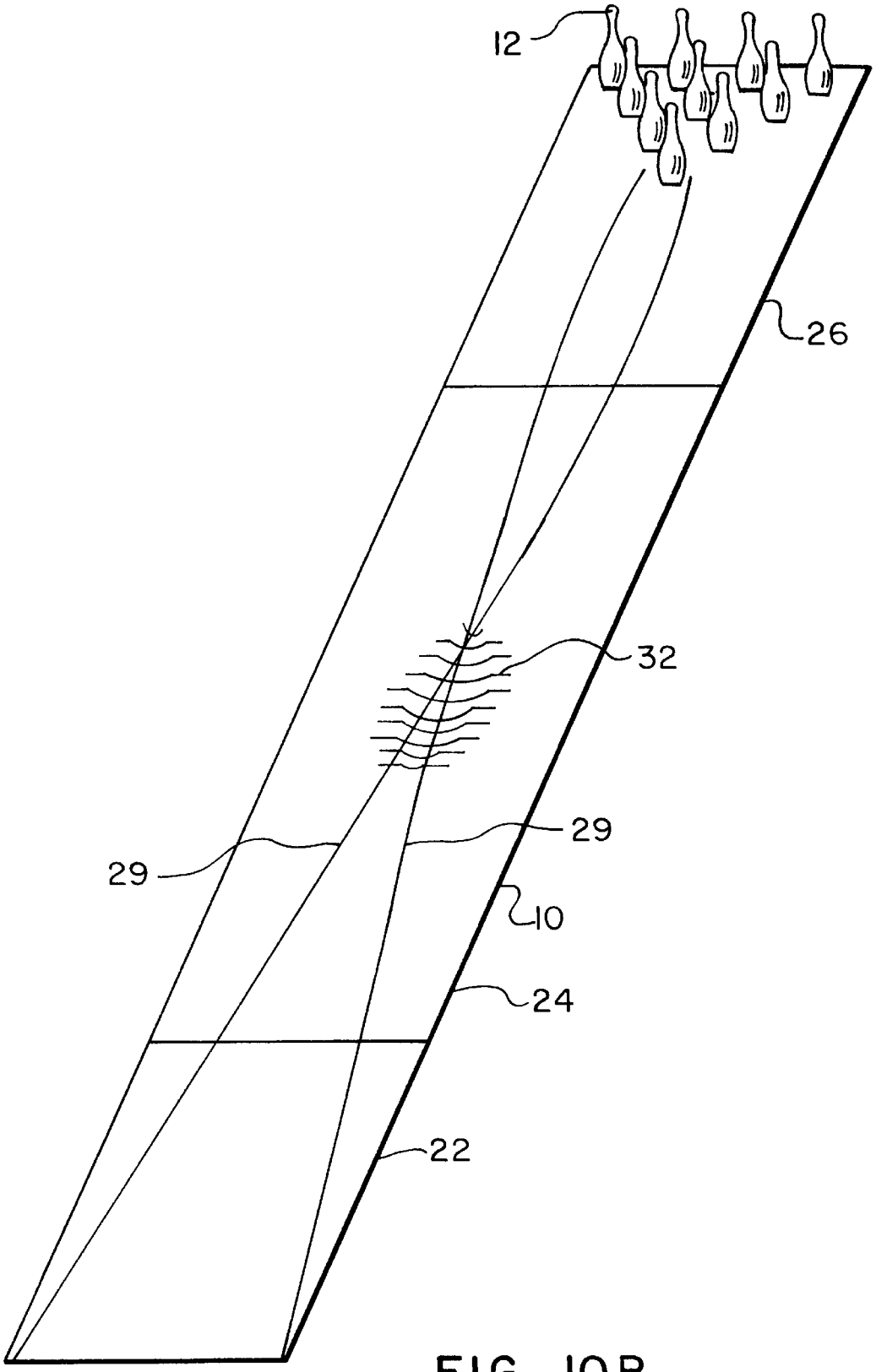
FIG. 10B shows another embodiment of the present invention of a bowling lane having a depression.

FIG. 10B shows a central depression 32 positioned in the center of the directional area 24. The bowler in this case would have to bowl over the depression to properly position the bowling ball.

Figure 11:
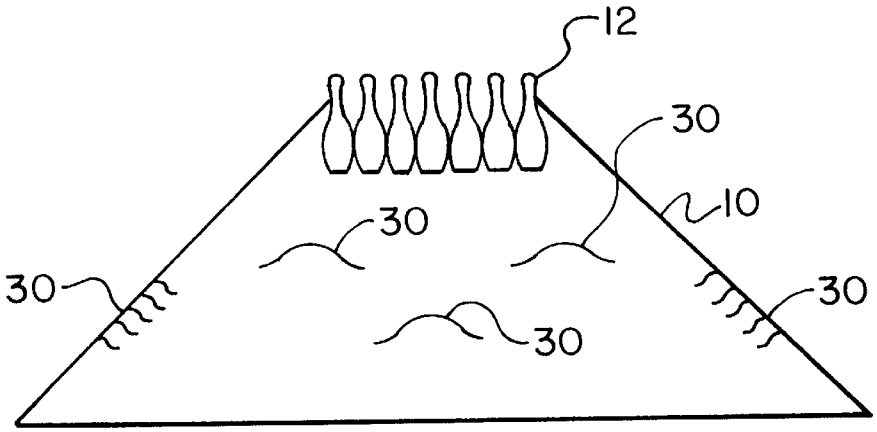
FIG. 11 shows a top perspective view of another embodiment of the present invention showing moguls.
Figure 12:
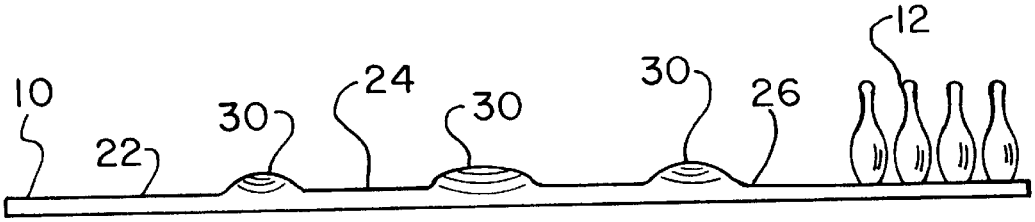
FIG. 12 shows a side view of the bowling lane shown in FIG. 11.

FIGS. 11 and 12 show a bowling lane 10 having moguls that simulate the lane 10 shown in FIG. 3, i.e., the moguls 30 are positioned where high friction areas result from low levels of oil. Specifically, FIG. 11 shows the lane 10 as the bowler sees it. In this manner the bowler can see all the obstacles of the lane 10 as opposed to guessing the friction areas as is presently done on oiled areas. FIG. 12 shows a side view of the lane 10 shown in FIG. 11.

The above-described bowling lanes 10 eliminate the guessing used today by bowlers as to how to play the ball due to improper or erratic oiling of the lanes.

Figure 13:
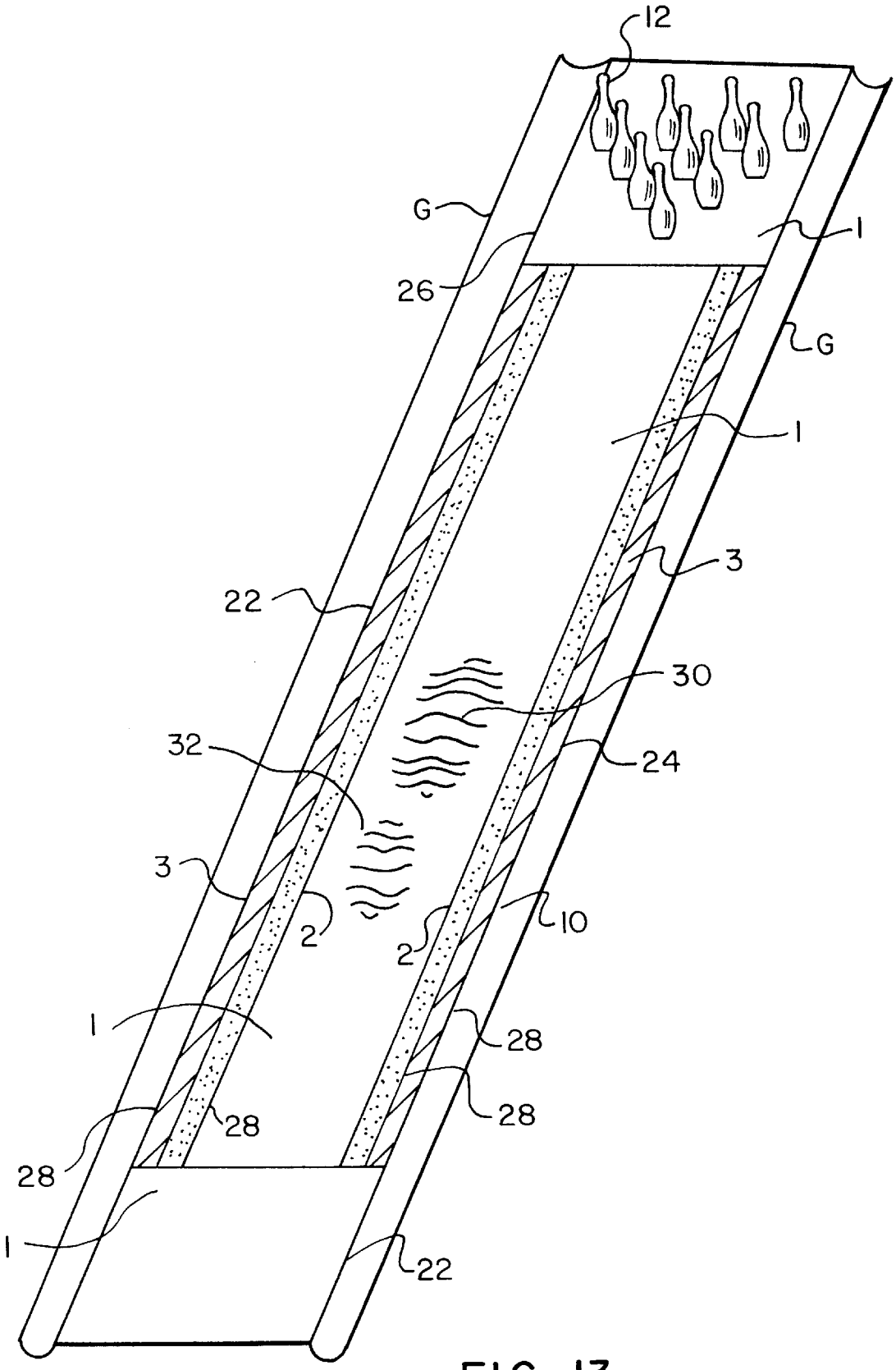
FIG. 13 shows another embodiment of the present invention.

The player can then properly position his ball around the above-described visual obstacles (i.e., friction pads, moguls, or depressions), or use these obstacles to direct the ball to get a strike or spare. In other words, the visual obstacles varyingly redirect the movement of the ball as it moves on the lane. By varyingly redirecting the ball, it is meant that depending where in the visual obstacle the ball travels, the ball will be directed differently. In the case of a mogul the ball will be directed differently if it travels over the top of the mogul versus a side of the mogul. The same is true for the friction pads and the depressions. The lanes 10 maximize the skill of the bowler and do not depend on the variables controlled by the lane owners. Further, to increase the interest and competition of the game, it is believed the particular arrangement of friction areas 27 and moguls 30 would be varied from lane to lane. For example, a forty lane bowling alley could have forty different layouts positioning friction pads 28 and/or moguls 30 and/or depressions 32. One such example would be combining the lanes 10 shown in FIGS. 5 and 10A or FIGS. 5 and 10B or FIGS. 5, 10B and 11. Another example is shown in FIG. 13. In this arrangement, the bowlers would play these lanes much as a golfer at a golf course, moving from lane to lane after each frame, until any given number of, or all forty, different lanes are played.

Preferably, in all of the above embodiments the lane surfaces are level, with the exception of the moguls 30 which protrude above the level lane surface, and depressions 32 which extend below the level lane surface. Although, if friction pads 28 are used, they may slightly protrude above the lane surface. Hence, in these cases these obstacles are at a different elevation than the remainder of the lane surface. Preferably, the moguls and the depressions are made of the same material as the remainder of the lane surface.

The moguls 30 can be secured on existing hardwood bowling lanes. Specifically, the moguls 30 can be machined from wood or plastic blocks attached to the lanes by gluing or nailing. The lanes would then be covered with a polyurethane coating to eliminate the need of lubricant. Alternatively, the lanes 10 could be fabricated from a plastic material, whereby the moguls would be molded, along with the remainder of the lane 10, and placed over a concrete or wooden foundation.

Friction pads can be made out of various types of colored plastics having roughened surfaces. The rougher the surface, the higher the friction coefficient. Also, rubber could be used for the friction pads 28. The pads 28 could then be secured to the lane within cutouts made in wooden lane 10. The remainder of the wooden lane 10 could then be coated with a polyurethane coating to eliminate the need of oiling. Alternatively, the various friction areas 27 could be formed by roughening the lane surface of a wooden lane whereby the roughened surfaces could then be painted or stained an appropriate color indicating the friction level.

The depressions 32 could be molded in a plastic lane or, in the case of an existing wooden lane, sections of the lane could be removed and replaced by wooden sections having depressions machined therein.

By utilizing the above type of oilless lanes, all players could use a uniform type of bowling ball (i.e., made of the same material), although the weight of the ball could be varied. In this manner, friction coefficient between the ball and the lane 10 would remain constant from ball to ball.

Also, although not shown, all of the lanes 10 can include gutters G. Alternatively, bumpers (such as those used in bumper bowling, which are well known in the art) could be provided in lieu of the gutters G.

Figure 14:
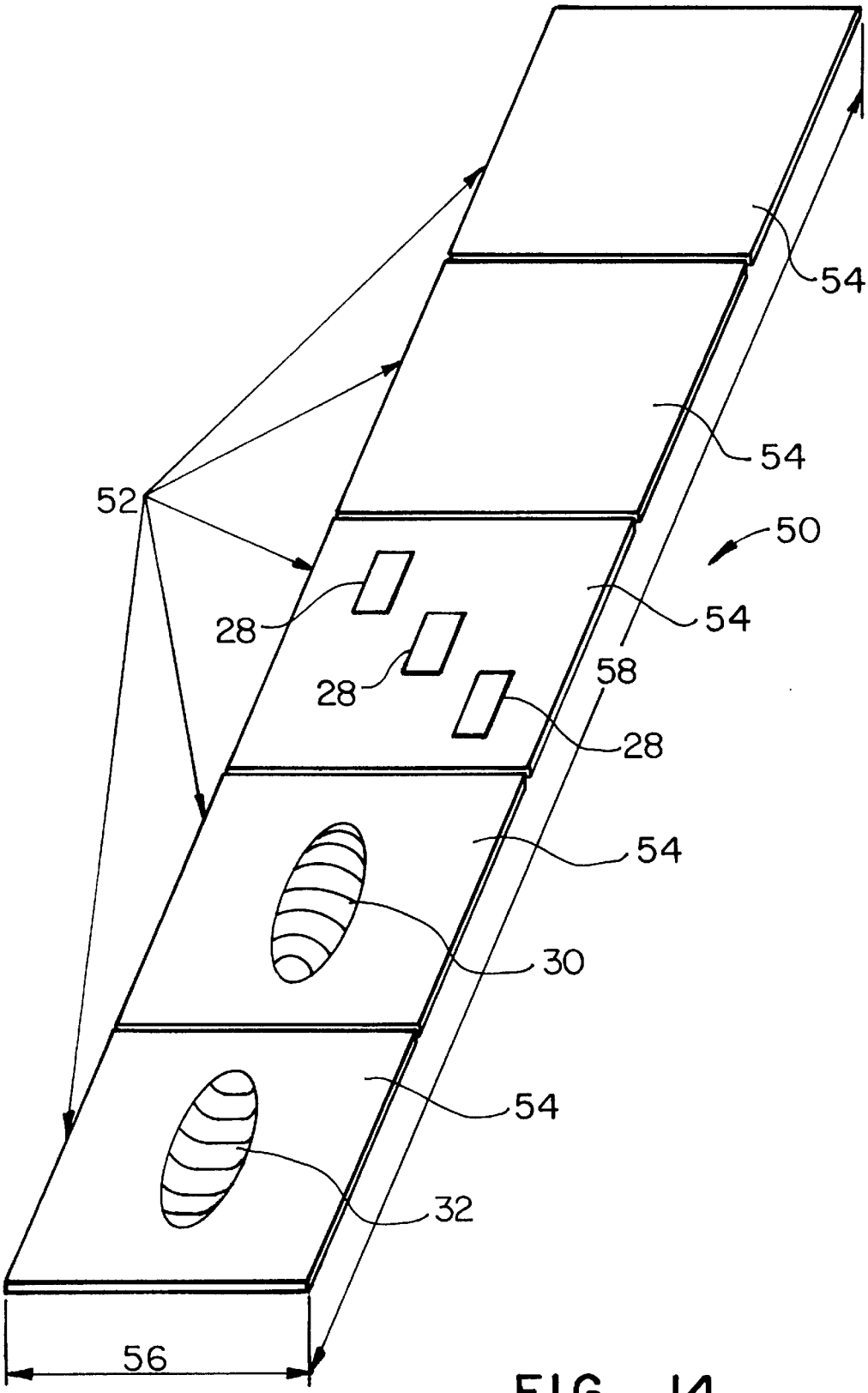
FIG. 14 shows a top perspective view of another embodiment of the present invention where the bowling lane is made of a plurality of panels.
Figure 15:
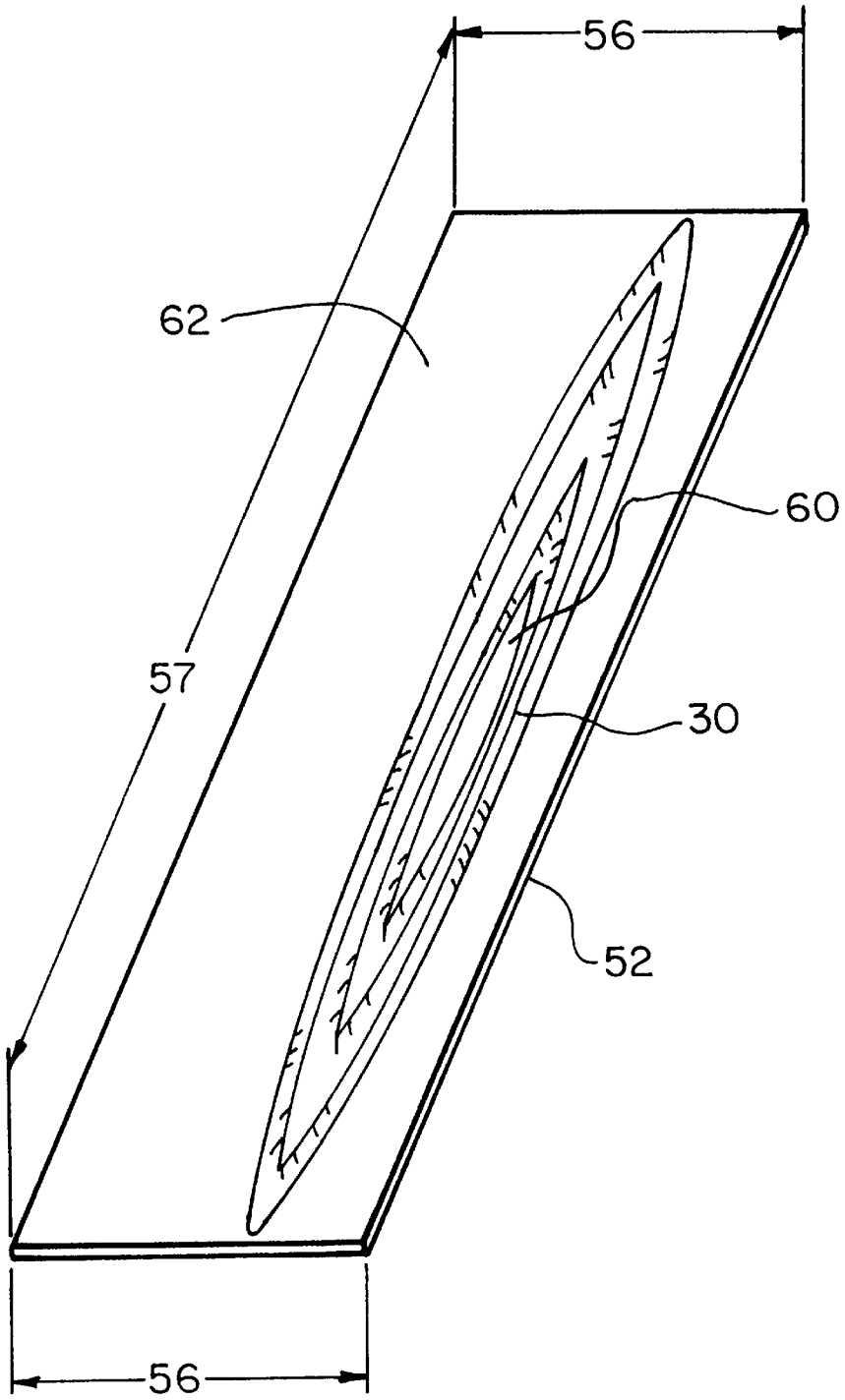
FIG. 15 shows a top perspective view of a panel shown in FIG. 14.
Figure 16:
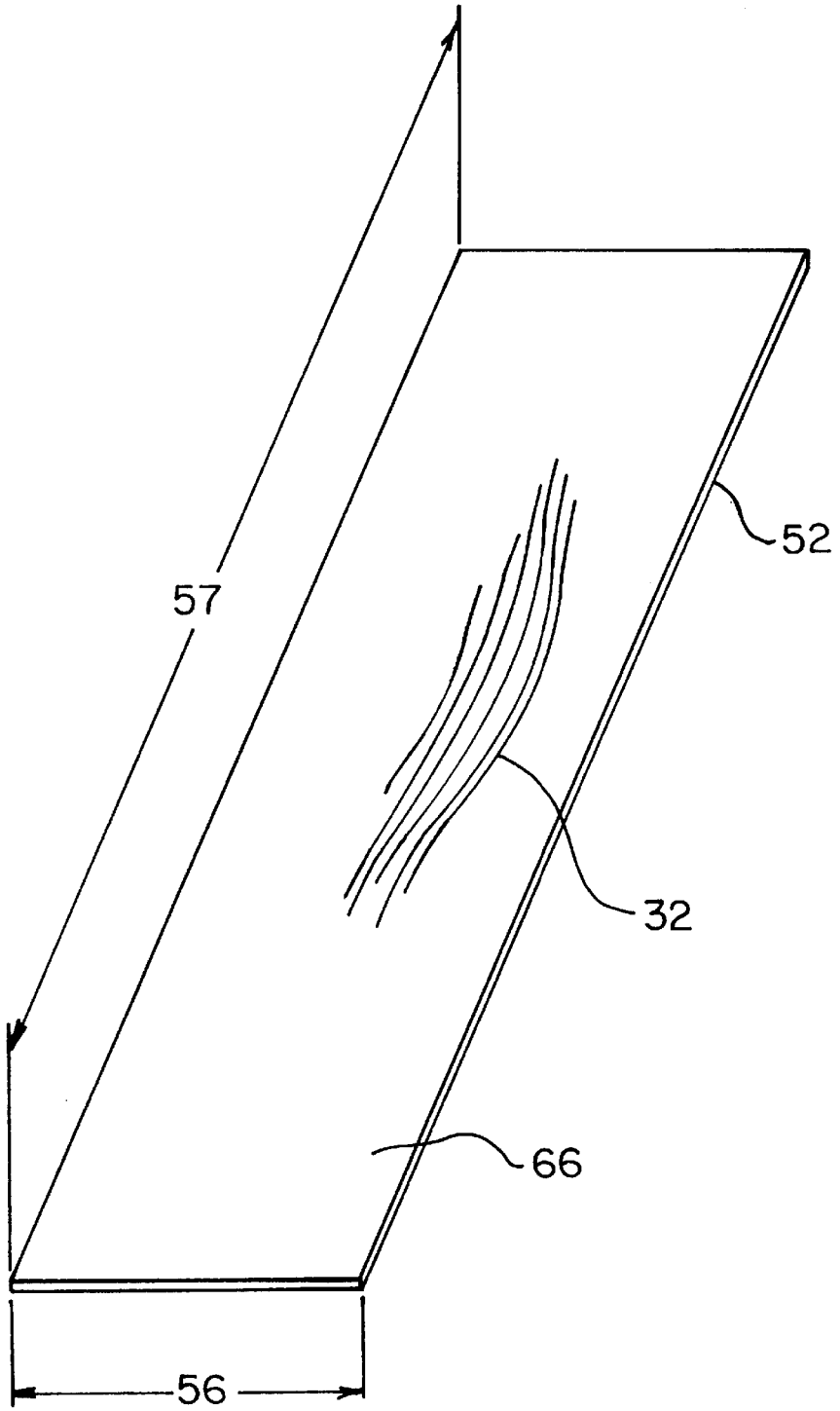
FIG. 16 shows a bottom perspective view of the panel shown in FIG. 15.

FIGS. 14–16 show another embodiment of the present invention which is similar to the earlier embodiment wherein like reference numerals will be used for like elements. Bowling lane 50 includes a plurality of interchangeable replaceable panels 52. Preferably, each of the panels 52 are made of an "oilless material" such as a polymeric material which results in an oilless lane. The panels 52 can be flat or include a visual obstacle or visual obstacles such as the previously described friction pads 28, moguls 30 or depressions 32. The remainder of the playing surfaces 54 are preferably flat, except for visual objects. The friction coefficient of the playing surfaces can be varied from panel to panel, and panels can be provided without visual objects. Preferably, each panel has a width 56, which is equal to a width of a bowling lane (forty-two inches). Preferably, five panels are provided, each having a length 57 of twelve feet, so that the sum of the lengths 57 equals a length 58 of a standard bowling lane (sixty feet). Bumpers or gutters such as previously described can be positioned adjacent edges of the bowling lane 50. Preferably, each panel has a thickness 59 of 0.375 inches and preferably the maximum height 60 of the moguls can vary between 1/16 of an inch to two inches. Preferably, the panels 52 are formed so that a mogul 30 extends from a first surface 62, and when the panels are rotated 180 degrees to expose a second or opposite surface 66, the portion of the panel 52 that corresponds to the mogul exposes a depression 32. Hence, each panel 52 can include different visual objects on opposite surfaces, be it moguls 30 and depression 32, or different frictional pads or different coefficients of friction.

In the foregoing specification, I have described the presently preferred embodiments of my invention and method for practicing the invention. However, it will be understood that the invention can be otherwise embodied and practiced within the scope of the appended claims.

I claim:

1. A bowling game made up of a plurality of frames, comprising:

a bowling ball; and a plurality of bowling lanes, each bowling lane having a laydown area, a directional area and a back end area, each lane provided with at least one pin, each of the bowling lanes defining a playing surface adapted to have at least one bowling pin set up at the back end area and the bowling ball thrown by a bowler at the laydown area so that said bowling ball moves on the playing surface toward the bowling pin, the playing surface comprising a layout having at least one visual obstacle means for redirecting movement of said bowling ball as said bowling ball moves in said lane, and one of channels or bumpers defined along opposite edges of the playing surfaces, wherein each of said lanes having a different layout whereby an object of said game is for a bowler to move from lane to lane after each frame until a plurality of different lanes are played, and wherein each of said bowling lanes comprises a plurality of panels, wherein at least one of said panels includes said visual obstacle means.

2. A bowling game as claimed in claim 1 wherein said visual obstacle means of one of said lanes has a different coefficient of friction than the remainder of the playing surface.

3. A bowling game as claimed in claim 2 wherein said one of said lane's visual obstacle means has a surface with varying coefficients of friction that is adapted to coact with a bowling ball.

4. A bowling game as claimed in claim 1 wherein one of said lanes includes a playing surface having a level surface with a plurality of visual obstacle means.

5. A bowling game as claimed in claim 4 wherein said one of said lane's visual obstacle means is of a different color than the remainder of the playing surface and has a different coefficient of friction than the remainder of the playing surface.

6. A bowling game as claimed in claim 4 wherein said one of said lane's visual obstacle means is selected from the group of moguls and depressions.

7. A bowling game as claimed in claim 4 wherein said one of said lane's visual obstacle means includes at least one visual obstacle means at a different elevation than the remainder of the playing surface and at least one visual obstacle means having a coefficient of friction different than the remainder of the playing surface.

8. A bowling game as claimed in claim 7 wherein said visual obstacle means at a different elevation is selected from the group of moguls and depressions.

9. A bowling game as claimed in claim 1 wherein said visual obstacle means of one of said lanes is at a different elevation than the remainder of said playing surface.

10. A bowling game as claimed in claim 6 wherein said one of said lane's visual obstacle means is at least one of a mogul or a depression.

11. A bowling game as claimed in claim 1 wherein said playing surfaces are formed of wood or laminated compressed paper.

12. A bowling game as claimed in claim 1 wherein each of said lanes has ten pins.

13. A bowling game as claimed in claim 1 wherein said visual obstacle means comprise moguls.

14. A bowling game as claimed in claim 1 wherein the visual obstacle means is selected from the group of depressions, moguls and colored areas of the lane indicating various coefficients of friction.

15. A bowling game as claimed in claim 1 wherein said panels are interchangeable.

16. A bowling game as claimed in claim 15 wherein said panels include a first surface and a second surface, wherein visual obstacle means are provided on both of said surfaces.

17. A bowling game as claimed in claim 1 wherein said panels define an oilless lane.

18. A bowling game as claimed in claim 1 wherein each of said lanes has a width and said panels forming said lane have a width equal to the width of said lane.

19. A method of playing a bowling game made up of a plurality of frames, comprising the steps of:

a) providing a bowling ball;

b) providing a plurality of bowling lanes, each bowling lane having a laydown area, a directional area and a back end area, each lane provided with at least one pin, each of the bowling lanes defining a playing surface adapted to have the at least one bowling pin set up at the back end area and the bowling ball thrown by a bowler at the laydown area so that said bowling ball moves on the playing surface toward the bowling pin, the playing surface comprising a layout having at least one visual obstacle means for redirecting movement of the bowling ball as the bowling ball moves in the lane, and one of channels and bumpers defined along opposite edges of the playing surfaces, wherein each of said lanes having a different layout;

c) arranging the at least one pin at the back end area of each lane;

d) throwing the ball at the laydown area of a respective one of the lanes toward the at least one pin arranged on that lane so that the ball moves along the playing surface;

e) coacting the ball with the respective visual obstacle means of the respective lane so as to redirect the movement of the ball along the playing surface, wherein the object of the game is for the ball to knock down as many of the pins as possible for a frame; and f) moving to another lane having a different layout than the previous lanes and repeat steps d)–f) until a plurality of frames have been played on different layouts.

20. The method as claimed in claim 19 wherein the visual obstacle means is selected from the group of depressions, moguls, and colored areas of the lane indicating various coefficients of friction.

21. A bowling game, comprising:

a bowling ball; and a plurality of bowling lanes, each bowling lane having a laydown area, a directional area and a back end area, each lane provided with at least one pin, each of the bowling lanes defining a playing surface adapted to have at least one bowling pin set up at the back end area and the bowling ball thrown by a bowler at the laydown area so that said bowling ball moves on the playing surface toward the bowling pin, the playing surface comprising at least one visual obstacle means for redirecting movement of said bowling ball as said bowling ball moves in said lane, and one of channels or bumpers defined along opposite edges of the playing surfaces, wherein said visual obstacles vary from lane to lane with at least one of said visual obstacles comprising a depression.

* * * * *

UNITED STATES PATENT AND TRADEMARK OFFICE

CERTIFICATE OF CORRECTION

PATENT NO. : 5,830,073

DATED : November 3, 1998

INVENTOR(S) : Brian C. Voss

It is certified that error appears in the above-identified patent and that said Letters Patent is hereby corrected as shown below:

Claim 10 Column 7 Line 46 "in claim 6" should read --in claim 9--.

Signed and Sealed this

Twenty-fifth Day of May, 1999

*Attest:*

Q. TODD DICKINSON

*Attesting Officer*

*Acting Commissioner of Patents and Trademarks*